US011000140B2

(12) United States Patent
Capone

(10) Patent No.: US 11,000,140 B2
(45) Date of Patent: May 11, 2021

(54) BEVERAGE CONTAINER AND MECHANISM OF CONSUMING A BEVERAGE CONTAINED WITHIN SAID BEVERAGE CONTAINER

(71) Applicant: Carmine K. Capone, Denville, NJ (US)

(72) Inventor: Carmine K. Capone, Denville, NJ (US)

( * ) Notice: Subject to any disclaimer, the term of this patent is extended or adjusted under 35 U.S.C. 154(b) by 41 days.

(21) Appl. No.: 16/446,079

(22) Filed: Jun. 19, 2019

(65) Prior Publication Data

US 2019/0387907 A1 Dec. 26, 2019

Related U.S. Application Data

(60) Provisional application No. 62/688,706, filed on Jun. 22, 2018.

(51) Int. Cl.

| | |
|---|---|
| ***A47G 19/22*** | (2006.01) |
| ***B65D 43/02*** | (2006.01) |
| ***A47G 21/18*** | (2006.01) |

(52) U.S. Cl.

CPC ..... *A47G 19/2272* (2013.01); *A47G 21/186* (2013.01); *B65D 43/0218* (2013.01); *B65D 43/0225* (2013.01); *B65D 2231/022* (2013.01)

(58) Field of Classification Search

CPC ..... A47G 19/2272; A47G 21/186; B65D 43/0218; B65D 43/0225; B65D 43/0216

USPC ..... 220/709, 705, 707

See application file for complete search history.

(56) References Cited

U.S. PATENT DOCUMENTS

| | | | | |
|---|---|---|---|---|
| 2,546,122 | A * | 3/1951 | Goldfarb | A47G 19/2222 446/72 |
| 4,462,544 | A * | 7/1984 | Rutzel | A47G 19/2266 215/388 |
| 4,709,831 | A * | 12/1987 | Coplan | B01D 63/02 220/288 |
| 4,775,060 | A * | 10/1988 | Pinney | A47G 19/2222 215/391 |
| 5,518,142 | A | 5/1996 | Lin | |
| 6,336,566 | B1 | 1/2002 | Lipson | |
| 2004/0140314 | A1 | 7/2004 | Li | |
| 2004/0245257 | A1 * | 12/2004 | Lipson | A47G 21/18 220/709 |
| 2008/0128427 | A1 * | 6/2008 | Friedman | A47G 21/18 220/507 |

(Continued)

OTHER PUBLICATIONS

"Planes Loopity Loop Tumbler," Zak! designs, downloaded on: Sep. 19, 2019, retrievable at: https://www.zak.com/planes_blue_plastic_water_bottle_PLNC-N220.

(Continued)

*Primary Examiner* — J. Gregory Pickett
*Assistant Examiner* — Sanjidul Islam
(74) *Attorney, Agent, or Firm* — Gearhart Law LLC

(57) ABSTRACT

Described herein is a container for a beverage as well as a structure to allow a user to drink the beverage contained therein. In at least one embodiment, there is a beverage container and straw combination that allows for a unique transportation of the liquid through the straw. The straw may be configured to pass through a lid of the beverage container multiple times and pass through a hollow or channel positioned above a lid of the beverage container.

20 Claims, 5 Drawing Sheets

(56) References Cited

U.S. PATENT DOCUMENTS

| | | | | |
|---|---|---|---|---|
| 2009/0039093 | A1* | 2/2009 | Forsythe | A47G 19/2266 220/709 |
| 2011/0121009 | A1* | 5/2011 | Alvares | B65D 43/021 220/780 |
| 2012/0048870 | A1 | 3/2012 | Ellerbe, III | |
| 2012/0055818 | A1 | 3/2012 | Zimmern | |
| 2015/0359362 | A1* | 12/2015 | Lee | A47G 19/2272 220/713 |
| 2016/0114937 | A1 | 4/2016 | Hylton | |
| 2017/0112308 | A1 | 4/2017 | Bennevendo | |

OTHER PUBLICATIONS

"Zak Designs Disney's Sofia the First Loopity Loop Tumbler, 11-Ounce," Zak! designs, downloaded on: Sep. 19, 2019, retrievable at: https://www.amazon.com/Zak-Designs-Loopity-Tumbler-11-Ounce/dp/B00EVM5C1K#customerReviews.

* cited by examiner

BEVERAGE CONTAINER AND MECHANISM OF CONSUMING A BEVERAGE CONTAINED WITHIN SAID BEVERAGE CONTAINER

CLAIM OF PRIORITY

This application is a United States non-provisional application and claims priority to U.S. Provisional Patent Application No. 62/688,706, filed Jun. 22, 2018 and herein incorporated by reference in its entirety.

FIELD OF THE EMBODIMENTS

The field of the present invention and its embodiments relate to a container for a beverage as well as a means for drinking the beverage contained therein. In particular, there is a container and straw combination that allows for a unique transportation of the liquid through the straw.

BACKGROUND OF THE EMBODIMENTS

Various types of closure lids and beverage containers have been developed that have an opening through which a drinking straw is passed or forced to enable a user to apply suction and withdraw liquid material for consumption. For example, a drinking cup may be formed of paper or polymer material, to which is applied a friction or interference fitting lid that is typically composed of polymer material. The lid may further permit a drinking straw to be forced or passed through a drinking straw opening that is defined by lid.

However, many of these types of beverage containers are not aesthetically pleasing and often conform to a readily accepted and ubiquitous structure. The result being that drinking from the container becomes a routine and mundane task. Thus, there is a need for a beverage container that creates an illusion when one drinks from the beverage container. This creates a pleasing experience, especially for children, which keeps them engaged and encourages them to drink from the container regardless of the liquid contained therein. The present invention and its embodiments meets and exceeds these objectives.

U.S. Pat. No. 6,336,566 pertains to a combination drinking container and straw and method of manufacture. The container has at least one straw retaining member molded into either the outer or inner surface of the container wall, or a portion of the wall may be shaped to include a constricted stem. A malleable straw is fitted onto each such retaining member so that at least a portion of the pathway of the straw is defined by the retaining members. A first end of the straw extends into the container and a second end extends upwardly so that beverage may be sipped therefrom. A lid may close the container, the lid optionally including an aperture to permit passage of the straw, the straw passing through the aperture. Also disclosed is a lidded container wherein the lid is provided with an aperture. A first portion of a drinking straw extends from inside the container, through the hole and to the container's outside to form a hinge for the lid. A second portion of the straw is attached to the container. In this way, the lid remains attached to the straw and container even when removed from the container.

U.S. Pat. No. 5,518,142 pertains to a beverage container is equipped with a rotatable cover and an automatically extendable drinking straw. The container includes an open ended body closed by a removable cap, a straw unit inserted through a conduit on the cap, a cover member rotatably fitted on the cap for rotational movement relative to the cap between a first position allowing the straw to extend through a slot of the cover member and a second position folding the straw unit and closing the slot. A groove formed on the cap engages a raised spot formed on the inner edge of the cover member for indicating when the cover member is rotated to either the first or second position. The straw unit includes a first straw made of elastomeric material and a second straw made of rigid material and sized so that the first straw is held between the conduit and the second straw in a coaxial relation without the use of fastening elements.

U.S. Patent Application 2017/0112308 pertains to a lid for a drinking cup for two having a generally circular panel of flexible material and having a circular retaining rim securing the lid to the circular rim of a drinking cup. The lid has a pair of orienting and access receptacles depending from the circular panel and having side walls sufficiently spaced to receive a drinking straw therebetween. The receptacles have drinking straw orienting walls for orientation of a pair of drinking straws within a cup. The receptacles each have a drinking straw entry wall oriented at an abrupt angle with the orienting wall and having a perforation permitting a drinking straw to be forced through the perforation and into a cup to which said lid is assembled.

U.S. Patent Application 2012/0055818 pertains to a disposable (or recyclable) beverage container includes two or more liquid-tight subsections, each subsection adapted to hold a different beverage. The container can carry liquids to be mixed at a point of consumption, or the contents of each subsection can be consumed separately, at different times.

Various systems and methodologies are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

The present invention and its embodiments relate a container for a beverage as well as a means for drinking the beverage contained therein. Namely, there is a container comprised of a material configured to be non-permeable to at least one liquid, a lid to retain the at least one liquid within the container, and a straw having a configuration that allows for a transportation of the liquid through the straw.

Further, the lid has a structure adhered thereto that may take the form of an animal, person, character, symbol, letter, number, and the like or some combination thereof. The structure has at least one channel or hollow that the straw is configured to pass through. In practice, this gives the appearance of the structure to be "consuming" the beverage at the same time the person is drinking from the straw. In a preferred embodiment, the structure is a cartoon character and a child can drink from the straw creating the illusion that the cartoon character and the child are drinking the beverage simultaneously.

In one embodiment of the present invention there is a beverage container having a beverage vessel defining an opening, the beverage vessel configured to hold at least one liquid; a lid configured to engage the beverage vessel and cover the opening, wherein the lid has more than one opening; a straw configured to pass through at least one of the more than one opening; and a structure coupled to the lid, wherein the structure is positioned above one of the more than one opening, and wherein the structure is configured to allow the straw to pass therethrough.

In another embodiment of the present invention there is a beverage vessel having a base and a sidewall defining an opening, the beverage vessel configured to be non-permeable to at least one liquid; an opaque lid configured to engage the sidewall of the beverage vessel and cover the opening of the beverage vessel, wherein the opaque lid has at least three openings connecting an upper surface and a lower surface of the opaque lid; a flexible, transparent straw configured to pass through each of the at least three openings in the opaque lid; and a hollow structure coupled to the upper surface of the opaque lid, wherein the hollow structure is positioned above one of the at least three openings, and wherein the hollow structure has at least two openings configured to allow the flexible, transparent straw to pass therethrough.

In yet another embodiment of the present invention there is a beverage container having a beverage vessel with a base and a sidewall defining an opening, the beverage vessel configured to be non-permeable to at least one liquid; an opaque lid configured to engage the sidewall of the beverage vessel and cover the opening of the beverage vessel, wherein the opaque lid has at least three openings connecting an upper surface and a lower surface of the opaque lid; a flexible, transparent straw configured to pass through each of the at least three openings in the opaque lid; and a structure coupled to the upper surface of the opaque lid, the structure having at least one channel passing therethrough, wherein the structure is positioned above one of the at least three openings, and wherein the channel has at least two openings configured to allow the flexible, transparent straw to pass therethrough.

In another aspect of the present invention there is a beverage container lid having a lid configured to engage the beverage vessel and cover the opening, wherein the lid has more than one opening; a straw configured to pass through at least one of the more than one opening; and a structure coupled to the lid, wherein the structure is positioned above one of the more than one opening, and wherein the structure is configured to allow the straw to pass therethrough.

In general, the present invention succeeds in conferring the following, and others not mentioned, benefits and objectives.

It is an object of the present invention to provide a beverage container that is lightweight an inexpensive.

It is an object of the present invention to provide a beverage container that is easy to clean after use.

It is an object of the present invention to provide a beverage container that has an opaque lid and a translucent straw.

It is an object of the present invention to provide a beverage container that has a single, flexible straw.

It is an object of the present invention to provide a beverage container that has a segmented straw.

It is an object of the present invention to provide a beverage container that has a character structure attached to the container.

It is an object of the present invention to provide a beverage container that creates an illusion when drinking from the beverage container.

It is an object of the present invention to provide a beverage container that makes sounds and/or has integrated lighting.

DESCRIPTION OF THE PREFERRED EMBODIMENTS

Figure 1:
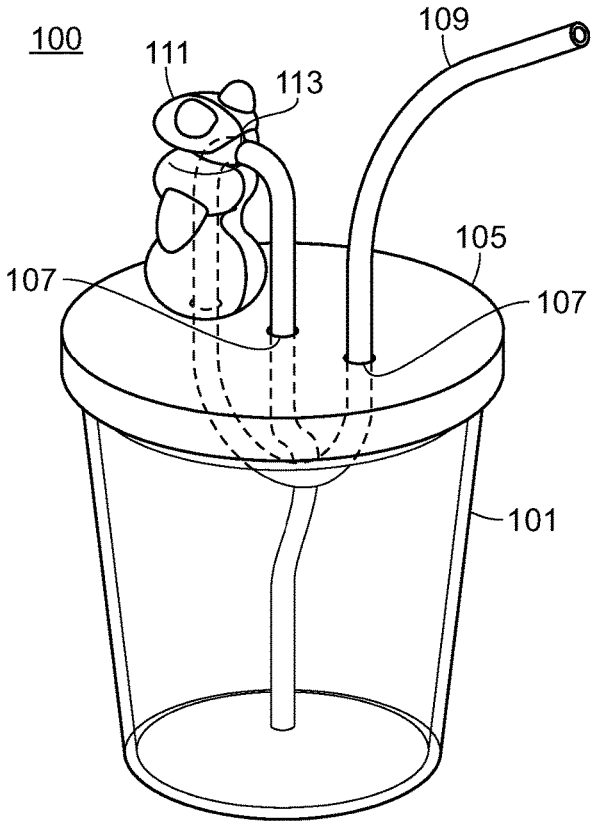
FIG. 1 is a perspective view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
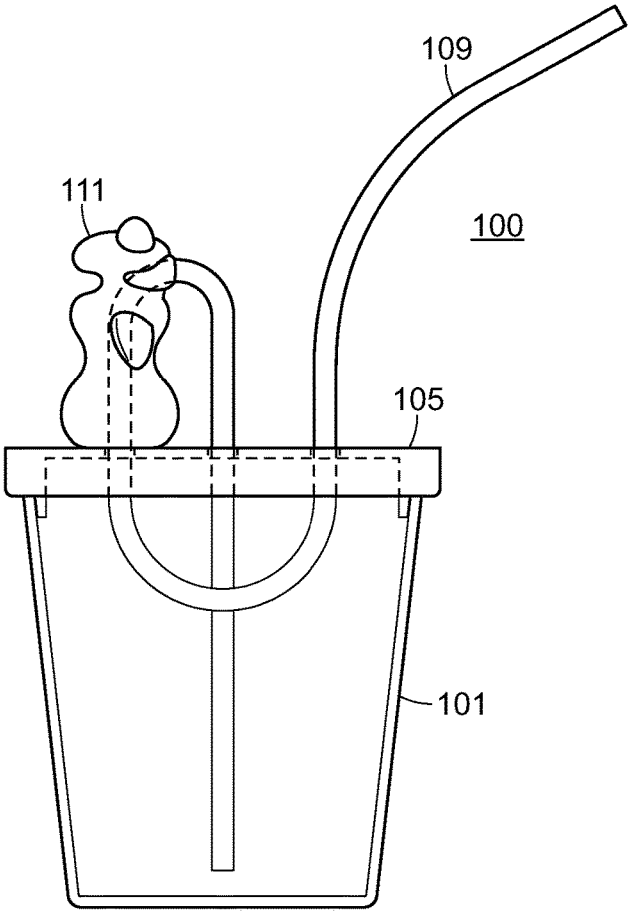
FIG. 2 is a side view of an embodiment of the present invention.
Figure 3:
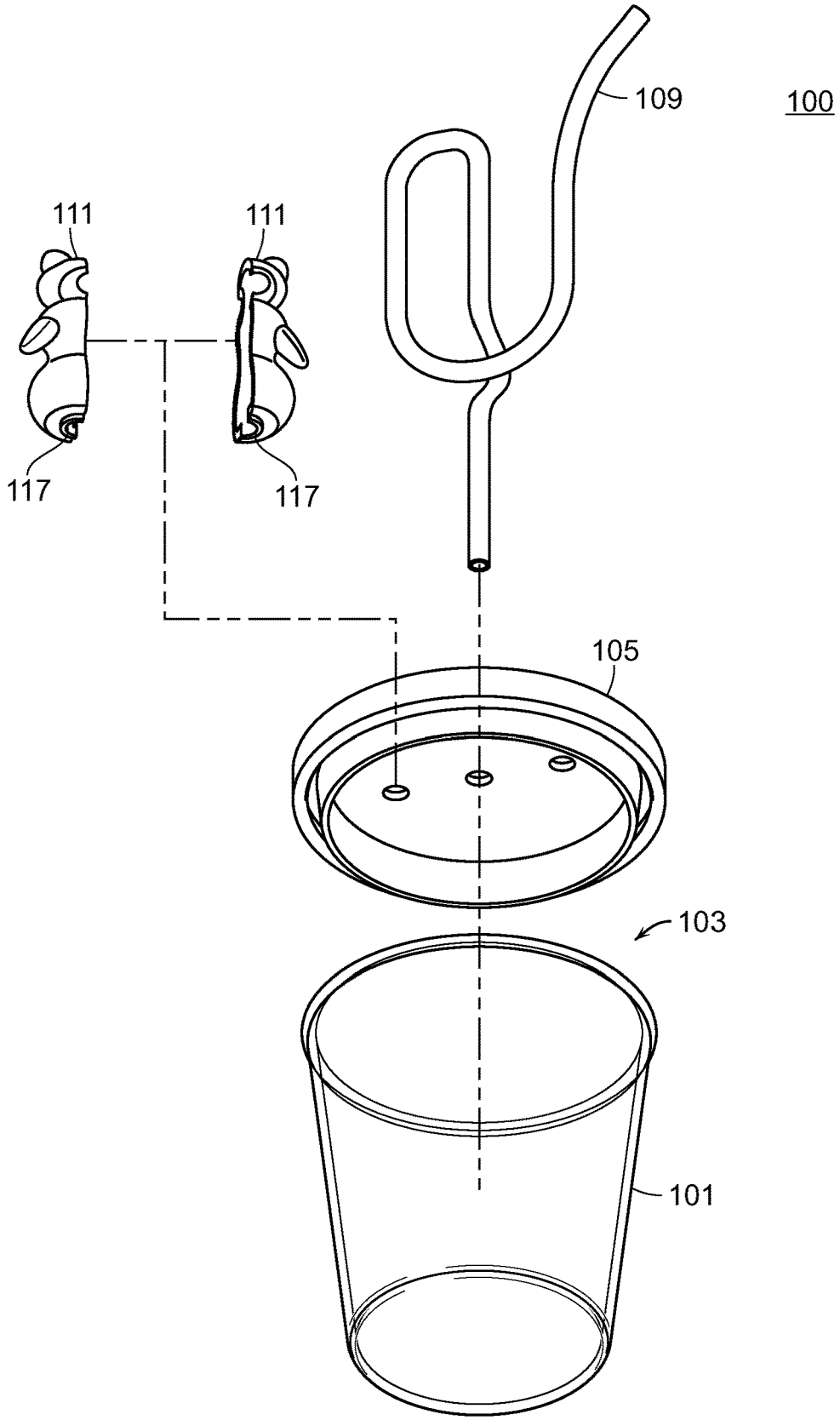
FIG. 3 is an exploded parts view of an embodiment of the present invention.

Referring now to FIGS. 1-7, there is a beverage container 100 generally having a beverage vessel 101, lid 105, straw 109, and structure 111. The lid 105 is detachable from the beverage vessel 101. The lid 105 may engage with the beverage vessel 101 by way of a friction fit, threading, or other suitable means. The beverage vessel 101 has a base and at least one sidewall defining an opening 103 (as shown in FIG. 3). In a preferred embodiment, the beverage vessel 101 may be clear, opaque, or have imagery thereon and the straw 109 is preferably transparent.

Figure 5:
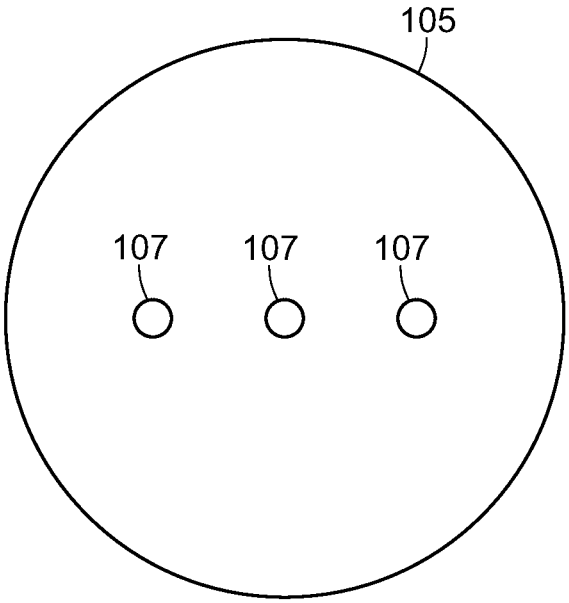
FIG. 5 is a view of a bottom of a lid of a beverage container of the present invention.

The lid 105, as shown in FIG. 5, has a number of openings 107 connecting a top surface of the lid 105 with a bottom surface of the lid 105. In at least one embodiment, the openings 107 are arranged linearly across the lid 105. In other embodiment, the openings 107 are configured to be arranged in a number of location across the lid 105. The number of openings 107 may range and preferably there are at least three openings and may have up to ten openings depending on the desired configuration for the structure 111 and the straw 109.

The straw 109 is preferably flexible and formed from a continuous length of material such that it can easily be passed through the openings 107 in the lid and the first opening 113 and the second opening 117 of the structure 111. In at least one embodiment, the straw 109 is clear or transparent. This allows the user and those around them to visualize the liquid being drawn through the straw 109 when in use. The straw 109 may comprise various materials including but not limited to polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof. Preferably, the straw 109 is comprised of a singular piece of PVC.

In another embodiment, the straw 109 can be segmented, that is, formed from multiple, distinct lengths of material. In such an embodiment, one segment of the straw 109 is positioned inside the beverage vessel 101 and coupled to the lid 105 or through the lid 105 onto the structure 111. The structure 111, as described below, can simply comprise a molded tubular channel instead of being entirely hollow. The bottom side of the structure 111 can have an extended straw segment that passes through the lid 105. Another segment of the straw can go extend from the structure 111 to an attachment point under the lid 105 on the opposite side of the structure 111. Another straw segment can then be coupled to a top surface of the lid 105 and be positioned to extend to the user's mouth.

In use, when the user draws liquid through the straw 109, the liquid moves up through the clear/transparent straw 109 into the structure 111 first, then through the structure 111 and down under the lid 105 and up again through the lid 105 on the opposite side from the structure 111, and up to the user's mouth. This, in turn, gives the effect that the structure 111 (embodied as a character as described below) is drinking along simultaneously with the user.

The structure 111 preferably takes the form of a cartoon character or other visual character, logo, symbol, design, etc. or some combination thereof. Preferably there is one structure 111 coupled to each of the beverage containers 100, but in some embodiments two or more structures 111 may be coupled to a singular beverage container 100. The cartoon character or structure 111 may have the straw 109 pass through a mouth of the character. The straw may also pass through other unique points on the structure 111 to create a unique beverage experience. In at least one embodiment, the structure is formed from a solid piece of PVC with a channel section 121 (see FIG. 7) molded out of the body to allow for the straw 109 to pass through. In other embodiments, the structure 111 is hollow and has a first opening 113 and a second opening 117 to accommodate the straw 109.

Preferably, as described herein, the structure 111 is coupled to an upper surface of the lid 105. However, in another embodiment, the structure 111 could be coupled to the side of the beverage vessel 101 or another surface of the beverage container 100. In one embodiment, the structure 111 could be used as a handle for the beverage container 100. Here, a portion of the structure 111 could be raised above the top edge of the beverage vessel 101 and the straw 109 can enter the structure 111 and return inside the beverage vessel 101 then back up either inside or outside of the beverage vessel 101. Such an embodiment could incorporate a lid or may be able to be designed without a lid.

Referring now to FIG. 1, the lid 105 is coupled to the beverage vessel 101. The straw 109 is maneuvered through the openings 107 such that a first end of the straw 109 is positioned within a reservoir of the beverage vessel 101 and a second end of the straw 109 is positioned above the lid 105 and in a position to be utilized by a user. Additionally, the straw 109 passes through a first opening 113 and a second opening 117 (see FIG. 3) of the structure 111. FIG. 2 illustrates an outward view of the beverage container 100, in one embodiment, once assembled and ready for use.

Figure 4:
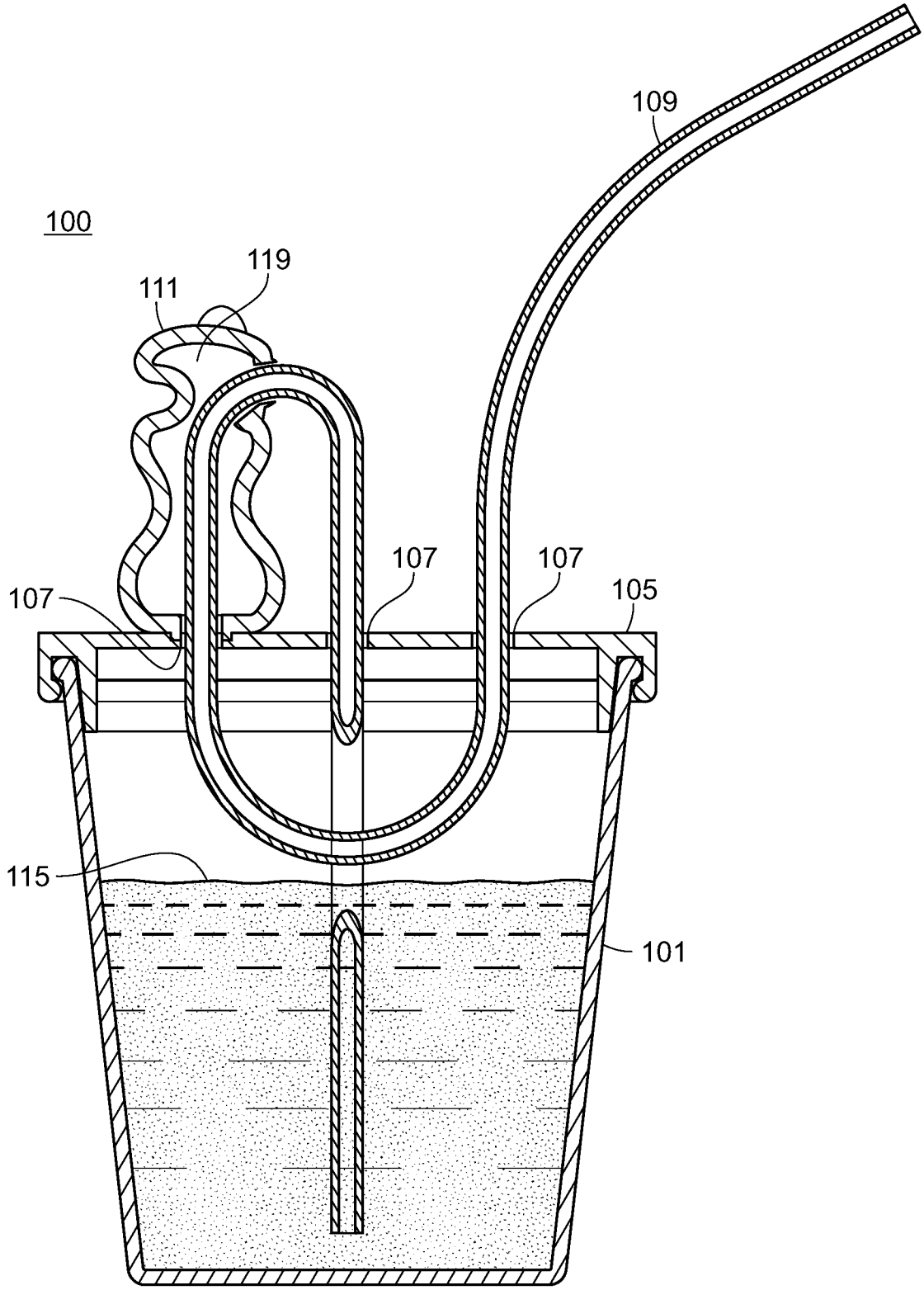
FIG. 4. is a sectional side view of an embodiment of the present invention.
Figure 7:
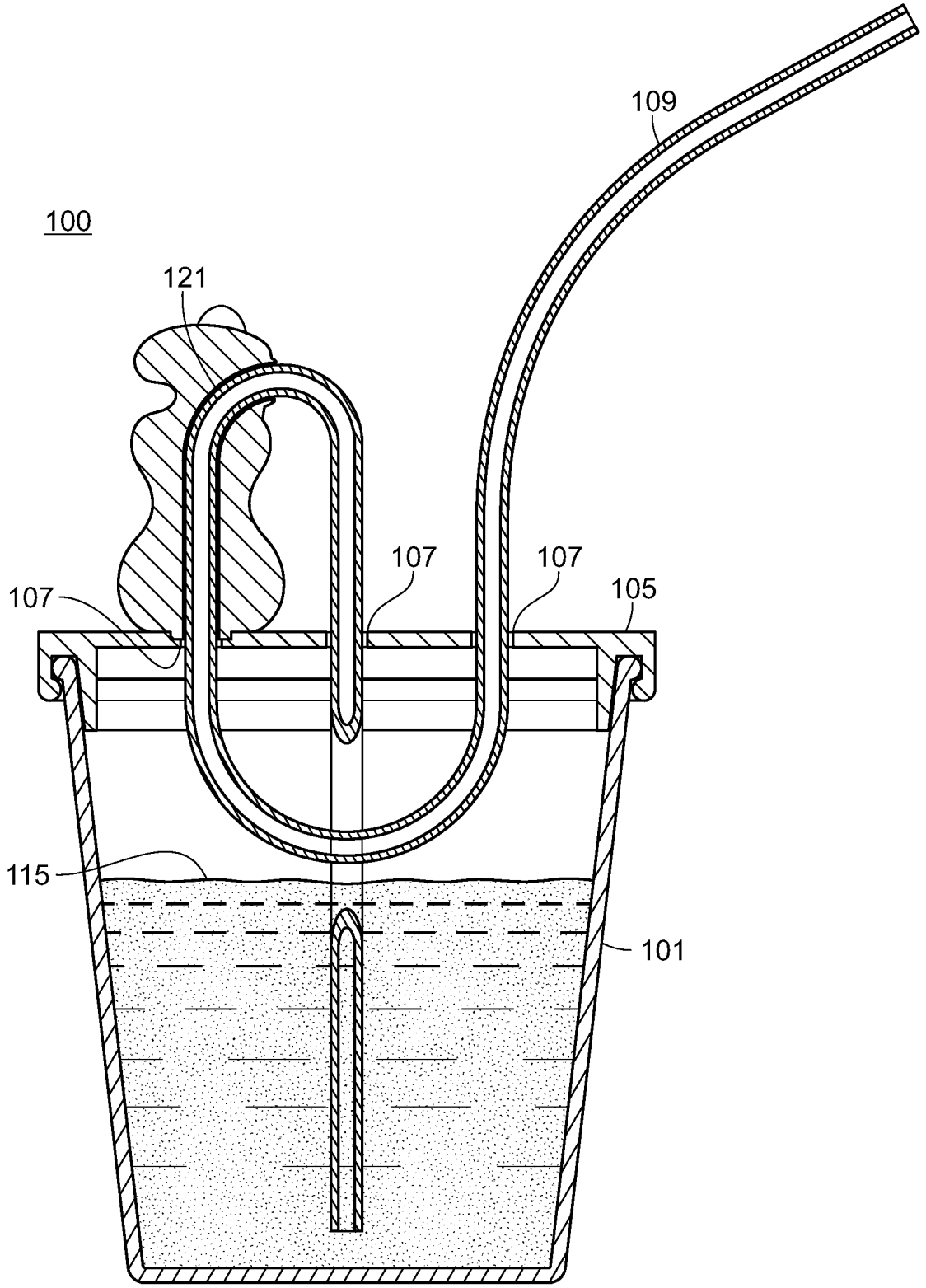
FIG. 7 is a sectional side view of a second embodiment of the present invention.

FIGS. 4 and 7 both illustrate sectional side views of embodiments of the beverage container 100. In FIG. 4, the beverage container 100 is shown with the structure 111 being a hollow. Here, there is a liquid 115 contained within the beverage vessel 101. The lid 105 is coupled to the beverage vessel 101 to prevent spillage of the liquid 115 when the beverage container 100 is in use by a user. The straw 109 is passed through the openings 107 in the lid 105 as well as the first opening 113 and second opening 117 in the structure 111.

As shown in FIG. 7, the beverage container 100 is shown with the structure 111 having a molded channel 121 with the straw 109 passing therethrough. Here, there is a liquid 115 contained within the beverage vessel 101. The lid 105 is coupled to the beverage vessel 101 to prevent spillage of the liquid 115 when the beverage container 100 is in use by a user. The straw 109 is passed through the openings 107 in the lid 105 as well as the first opening 113 and second opening 117 in the structure 111.

Figure 6:
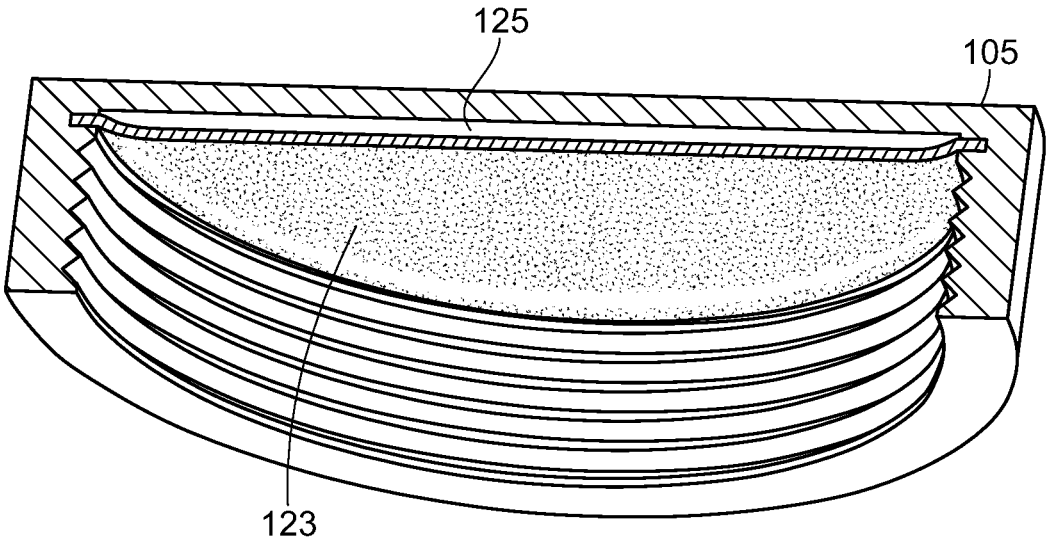
FIG. 6 is a view of a bottom of an alternate lid of a beverage container of the present invention.

In an alternate embodiment, as shown in FIG. 6, the lid 105 has a covering 123 on an underside of the lid 105 and a bladder 125 contained between a bottom surface of the lid 105 and the covering 123. In this embodiment, it is preferable that the beverage vessel 101 and lid 105 are threadably engaged. The bladder 125 is configured to seal along the edges of the beverage vessel 101 when the lid 105 is coupled to the beverage vessel 101. Coupled to the bladder 125 is a thin tube (not shown) that extends up through the lid 105 and into the structure 111. This thin tube is inserted inside another thicker tube (not shown) that goes around the thin tube.

The thick tube is tightly to the lid 105 forming an air tight seal. The bladder 125 also has a downward descending attachment point, which a straw segment is attached to reach the bottom the beverage vessel 101. Lastly, the lid 105, has an attachment point, opposite of the structure 111 for another straw segment to be attached. In practice, a user draws liquid from the beverage vessel 101 via the straw 109. The liquid contained in the beverage vessel 101 comes up from the beverage vessel 101 into the bladder 125. The liquid then travels up the thin tube of the bladder 125, into the structure 111, which hides the overflow, and then returns down around the thin tube and back into the bladder 125, and is then drawn up through the lid 105 and to the user.

In other embodiments, lights and sound are may be incorporated into the embodiments of the beverage container 100. There may be several electronic switches available that can sense the movement of the liquid in the beverage vessel 101 and the movement of the liquid as it passes through the straw 109. In some embodiments, the electronic switch is a pressure switch For a battery operated embodiments of the present invention, it may be best to keep all of the electronics contained in the structure 111, which could be removable for cleaning. This could be achieved by having the structure 111 open up, which would then be removed from the lid 105 and would also reveal the battery compartment.

Although this invention has been described with a certain degree of particularity, it is to be understood that the present disclosure has been made only by way of illustration and that numerous changes in the details of construction and arrangement of parts may be resorted to without departing from the spirit and the scope of the invention. Additional images showing an embodiment of the invention are appended hereto.

What is claimed is:

1. A beverage container comprising:

a beverage vessel defining an opening;

a lid configured to engage the beverage vessel and cover the opening, wherein the lid has more than one opening;

a straw passing through each of the more than one opening of the lid; and a structure coupled to the lid, wherein the structure is positioned above one of the more than one opening of the lid, and wherein the structure is configured to allow the straw to pass through each of the more than one opening of the lid and at least one opening of the structure.

2. The container of claim 1 wherein the beverage vessel is configured to hold at least one liquid.

3. The container of claim 1 wherein the lid threadably engages the beverage vessel.

4. The container of claim 1 wherein the straw is flexible.

5. The container of claim 1 wherein the structure comprises a channel configured to receive the straw.

6. The container of claim 5 wherein the channel has a first opening and a second opening.

7. The container of claim 1 wherein the structure is hollow.

8. The container of claim 1 wherein the structure is removable from the lid.

9. The container of claim 1 wherein the structure has a first opening and a second opening.

10. The container of claim 9 wherein the second opening is positioned over and aligned with one of the more than one opening of the lid.

11. The container of claim 9 wherein the first opening is located above the second opening.

12. The container 1 wherein the straw is positioned to pass through two openings in the lid before or after passing through the structure.

13. The container of claim 1 wherein the structure comprises a first section engageable to a second section.

14. The container of claim 13 wherein the first section and the second section are separable from one another.

15. The container of claim 1 wherein the more than one opening are arranged linearly across the lid.

16. A beverage container lid comprising:

a lid configured to engage a beverage vessel, wherein the lid has more than one opening connecting a top surface and a bottom surface of the lid;

a straw passing through each of the more than one opening of the lid; and a structure coupled to the lid, wherein the structure is positioned above one of the more than one opening, and wherein the structure is configured to allow the straw to pass through each of the more than one opening of the lid and at least one opening of the structure.

17. The container lid of claim 16 wherein the lid is opaque.

18. The container lid of claim 16 wherein the straw is transparent.

19. A beverage container comprising:

a beverage vessel having a base and a sidewall defining an opening, the beverage vessel configured to be non-permeable to at least one liquid;

an opaque lid configured to engage the sidewall of the beverage vessel and cover the opening of the beverage vessel, wherein the opaque lid has at least three openings connecting an upper surface and a lower surface of the opaque lid;

a flexible, transparent straw passing through each of the at least three openings in the opaque lid; and a hollow structure coupled to the upper surface of the opaque lid, wherein the hollow structure is positioned above one of the at least three openings, and wherein the hollow structure has at least two openings in which the flexible, transparent straw passes therethrough.

20. A beverage container comprising:

a beverage vessel having a base and a sidewall defining an opening, the beverage vessel configured to be non-permeable to at least one liquid;

an opaque lid configured to engage the sidewall of the beverage vessel and cover the opening of the beverage vessel, wherein the opaque lid has at least three openings connecting an upper surface and a lower surface of the opaque lid;

a flexible, transparent straw passing through each of the at least three openings in the opaque lid; and a structure coupled to the upper surface of the opaque lid, the structure having at least one channel passing therethrough, wherein the structure is positioned above one of the at least three openings, and wherein the channel has at least two openings in which the flexible, transparent straw passes therethrough.

* * * * *